US007997946B2

(12) United States Patent
Sirmans

(10) Patent No.: US 7,997,946 B2
(45) Date of Patent: Aug. 16, 2011

(54) FLUSHING ASSEMBLY FOR OUTBOARD MOTOR

(76) Inventor: Dewayne Sirmans, Jupiter, FL (US)

( * ) Notice: Subject to any disclaimer, the term of this patent is extended or adjusted under 35 U.S.C. 154(b) by 93 days.

(21) Appl. No.: 12/052,875

(22) Filed: Mar. 21, 2008

(65) Prior Publication Data

US 2008/0233816 A1 Sep. 25, 2008

Related U.S. Application Data

(60) Provisional application No. 60/896,734, filed on Mar. 23, 2007.

(51) Int. Cl.

| | |
|---|---|
| ***B63H 20/30*** | (2006.01) |
| ***B63H 21/38*** | (2006.01) |
| ***B08B 3/02*** | (2006.01) |
| ***B08B 9/00*** | (2006.01) |
| ***B08B 9/032*** | (2006.01) |

(52) U.S. Cl. ..... 440/88 N; 134/167 R

(58) Field of Classification Search ..... 440/88 R, 440/88 N, 113; 134/166 R, 167 R, 168 R, 134/169 R, 169 A See application file for complete search history.

(56) References Cited

U.S. PATENT DOCUMENTS

| | | | | | |
|---|---|---|---|---|---|
| 3,931,828 | A * | 1/1976 | Lawler | 134/167 R |
| 4,246,863 | A * | 1/1981 | Reese | 440/88 R |
| 4,359,063 | A * | 11/1982 | Carlson | 134/167 R |
| 4,540,009 | A * | 9/1985 | Karls | 134/167 R |
| 4,973,276 | A | 11/1990 | Mavrelis | |
| 5,051,104 | A * | 9/1991 | Guhlin | 440/88 R |
| 5,336,012 | A * | 8/1994 | Newville | 401/289 |
| 5,362,265 | A * | 11/1994 | Gervais | 440/88 R |
| 5,397,256 | A * | 3/1995 | Bidwell | 440/88 R |
| 5,423,703 | A | 6/1995 | Lorenzen | |
| 5,823,836 | A * | 10/1998 | Anderson | 440/88 R |
| 6,165,033 | A * | 12/2000 | Cugini | 440/88 R |
| 6,314,973 | B1 * | 11/2001 | Vellines | 134/167 R |
| 7,150,665 | B1 * | 12/2006 | Soreide et al. | 440/88 N |

* cited by examiner

*Primary Examiner* — Ajay Vasudeva

(74) *Attorney, Agent, or Firm* — Mark D. Brown, Esq.; Malin Haley DiMaggio Bowen & Lhota, P.A.

(57) ABSTRACT

A flushing device that is used to remove salt water and other corrosive agents from the cooling system of an outboard motor. The flushing device includes an earmuff flushing accessory that is attached to the end of an elongate support member and is used to create sealed chambers that surround the end ports of the motor. The elongated member can either be directly coupled to the earmuff flushing accessory or coupled through an elbow extension member to allow for the operation of the device from various positions, including to the side, in front, or from behind the outboard motor. The device is configured so that the flushing liquid flows either directly from the elongated member or through a bent extension member into the earmuff flushing accessory, thereby eliminating the need for various separate components to control the flow of the liquid. The device, therefore, uses a simple design that is both inexpensive to manufacture and effective while eliminating potential sources of failure.

3 Claims, 3 Drawing Sheets

FLUSHING ASSEMBLY FOR OUTBOARD MOTOR

CROSS REFERENCE TO RELATED APPLICATIONS

This application claims the benefit of provisional U.S. Patent Application Ser. No. 60/896,734, filed on Mar. 23, 2007.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to an outboard motor flushing assembly, and more particularly to a telescopically adjustable motor flushing assembly with an ear muff flushing accessory supported completely by the flushing tube allowing for quick attachment and detachment of the device.

2. Description of Related Art

Most outboard motors use the surrounding water, whether salt or fresh water, to cool the engine during operation. By using the surrounding water as a cooling source, the need for complex cooling systems that recirculate refrigerant or fresh water is eliminated, thereby allowing for outboard motors that are both compact and efficient. The cooling water is pumped from the water source through all inlet port and into the engine. The inlet port is typically adjacent to the propeller to ensure that the intake valve remains submerged during the operation of the motor.

For boats with outboard motors that are operated in salt water environments, salt water is pumped in to cool the engine. The salt from the salt water can cause many problems associated with the maintenance of the outboard motor. These problems stem from the corrosive ability of aqueous salt solutions. As the salt water is pumped into the cooling system, the metallic walls of the cooling jacket naturally corrode. If the salt water remains in the engine cooling system, while the motor is not being operated, the metallic walls of the cooling jackets, and the hoses of the cooling system corrode even more. Eventually, the salt water can leak into the engine leading to corrosion within the combustion chambers and other parts the engine that are not suitable for contact with salt water. The order to solve this problem and avoid engine failure due to corrosion, onboard motors are routinely flushed with fresh or salt free water after every use, thereby removing substantially all of the salt water and salt residue from the cooling system.

Devices and assemblies for flushing outboard motors are detailed extensively throughout the prior art. Usually the flushing devices include a hose for carrying fresh water to the inlet port and a means of attaching The hose so that fresh water can circulate through the engine cooling system. Due to the positioning of the intake valve at the bottom of the outboard motor near the propeller, and the fact that outboard motors extends out from the side of the boat, it is difficult to connect the fresh water hose to the inlet port. Furthermore, since the inlet port is difficult to reach, the fresh water hose must be connected and sealed to the inlet port through a quick and easy means. U.S. Pat. No. 3,931,828 (1976) and U.S. Pat. No. 5,051,104 (1991) both describe a device that is used to attach the fresh water hose to the inlet port of an outboard motor. The device includes two rubber cups that are supported on a U-shaped steel spring to form an "earmuff" shape. The earmuffs wrap around the outboard motor and cover and seal opposing inlet ports. While the earmuffs provide an effective means of coupling a water hose to the inlet ports of an outboard motor, they require that a user be located in close proximity to the inlet ports in order to Install the earmuff flushing device. Since the inlet ports are located at the bottom of the onboard motor, it can be extremely difficult to achieve the necessary position that is required for installing the earmuffs, particularly when the boat is disposed on a lift or on an elevated dry dock rack.

U.S. Pat. No. 4,246,863 (1981) and U.S. Pat. No. 4,973,276 (1990) disclose a device that allows the earmuff system to be attached from a distant position. Both Inventions accomplish this by mounting the earmuffs on to the end of the pole. The invention described in '863 utilizes a second extending pole to operate a clamp that is used to tighten the earmuff. While both inventions do solve the problem of being able to attach the earmuffs from a remote distance, the inventions use heavy extension members that are rigidly secured to the earmuff, so that it becomes extremely difficult to operate the device and place the earmuff in a desired position.

U.S. Pat. No. 5,423,703 (1995) describes a tubular hollow pole that supports the U shaped coupling between the earmuffs and a water outlet, through which salt free water can flow. Furthermore, the invention includes a mechanism for controlling the flow of the water through the hollow pole, so that the device can be operated quickly. The disadvantage of that invention is that it still requires a separate water hose that connects the hollow support pipe to the cup of the earmuff, thus making the support system overly complex and burdensome to manipulate. Furthermore, the support structure is attached at a forty five degree angle with respect to the plane formed around the perimeter of the distal end of the sealing cups. By creating a forty five degree angle, the earmuffs are not designed for attachment from a position directly behind or directly to the side of the inlet ports.

U.S. Pat. No. 6,314,973 (2001) also describes a pole assembly that is designed to install an earmuff flushing device from within the boat. That device, as with the invention of '703 patent, includes a separate flow hose that separates from the hollow support member, through which water flows, and into the sealing cup of the earmuff flushing device. The disadvantages are similar to the '703 invention in that the invention described in '973 describes all invention that uses an overcomplicated support system. Furthermore, the invention is not bent and therefore does not accommodate for installation from a position directly to the side of the inlet ports on the outboard motor.

There therefore exists a need for a flushing system that provides a means for attaching the earmuff shaped flushing system used in outboard motors, that is not only simple in design and operation, but that allows for installation from a variety of positions. Unfortunately, the aforementioned attempts fail to solve this problem by providing designs that arc overly complicated, are difficult to operate, and can not be installed from a variety of positions. The present invention fills this void in the prior art by creating a support assembly through a simple design that is easily controllable, and attachable from various positions.

BRIEF SUMMARY OF THE INVENTION

The present invention provides a flushing system for flushing salt water from an outboard motor cooling system. The flushing system includes two separate sealing members that are mounted so as to completely cover and form a seal around opposing inlet ports, to allow for a continuous flow of fresh water into the cooling system. These rubber sealing members are coupled together through a connection member that extends around the outer surface of the outboard motor. The rubber cups in combination with the connection member are referred to as the earmuff flushing accessory of the flushing system. The earmuff flushing accessory is attached to a tubular elongate member, which provides structure for positioning the earmuff flushing accessory around the inlet ports, and supporting the earmuff in a fixed position while the flushing operation is performed. The tubular elongate member is hollow, and provides an enclosed channel through which fresh water or any other suitable flushing liquid flows through and is supplied directly to the earmuff flushing accessory. The tubular elongate member is preferably telescopically adjustable, enabling the adaptation of the elongate support member for precise and easy positioning of the earmuff flushing accessory. In addition, the elongate member is coupled to the earmuff forming a single piece, so that fresh water flows directly from the tubular elongate member into the earmuff without the use of separate components, such as flow tubes or hoses.

A significant aspect of the present invention involves providing alternate tubular end connectors, including a straight connector and a 90-degree connector, for use with the elongate tubular member. Using the straight connector allows the elongate member to be attached to the earmuff so that the elongate member is transversely disposed relative to the earmuff flushing device thereby enabling the user to easily attach the earmuff flushing device when positioned generally to the side of the outboard motor. Using the 90-degree connector allows the elongate member to be attached to the earmuff so that the elongate member is generally perpendicular to the transverse axis between the cups of the earmuff flushing device thereby enabling the user to easily attach the earmuff flushing device when positioned generally in front or behind the outboard motor, such as when the user is standing inside the boat near the transom or on a swim platform.

It is an object of the present invention to provide all onboard motor flushing system that allows a user to supply pressurized water to an onboard motor from a distance.

It is another object of the present invention to provide an onboard motor flushing system with a support system that is adjustable.

It is yet another object of the present invention to provide an onboard motor flushing system that can be operated from a position directly to the side of the onboard motor.

It is still another object of the present invention to provide all onboard motor flushing system that is adaptable for use with a separate attachment that allows for the operation of the device from a position directly in front of or behind the onboard motor.

It is another object of the present invention to provide an onboard motor flushing system that includes a simple design that uses a minimal number of components in order to reduce the chances of device failure.

It is another object of the present invention to provide an onboard motor flushing system that is compact, light and easy to maneuver.

It is still another object of the present invention to provide an onboard motor flushing system that is easy to operate.

It is yet another object of the present invention to provide an onboard motor flushing system that is inexpensive, dependable, and fully effective in accomplishing its intended purposes.

In accordance with these and other objects, which will become apparent hereinafter, the instant invention will now be described with particular reference to the accompanying drawings.

DETAILED DESCRIPTION OF THE INVENTION

Figure 1:
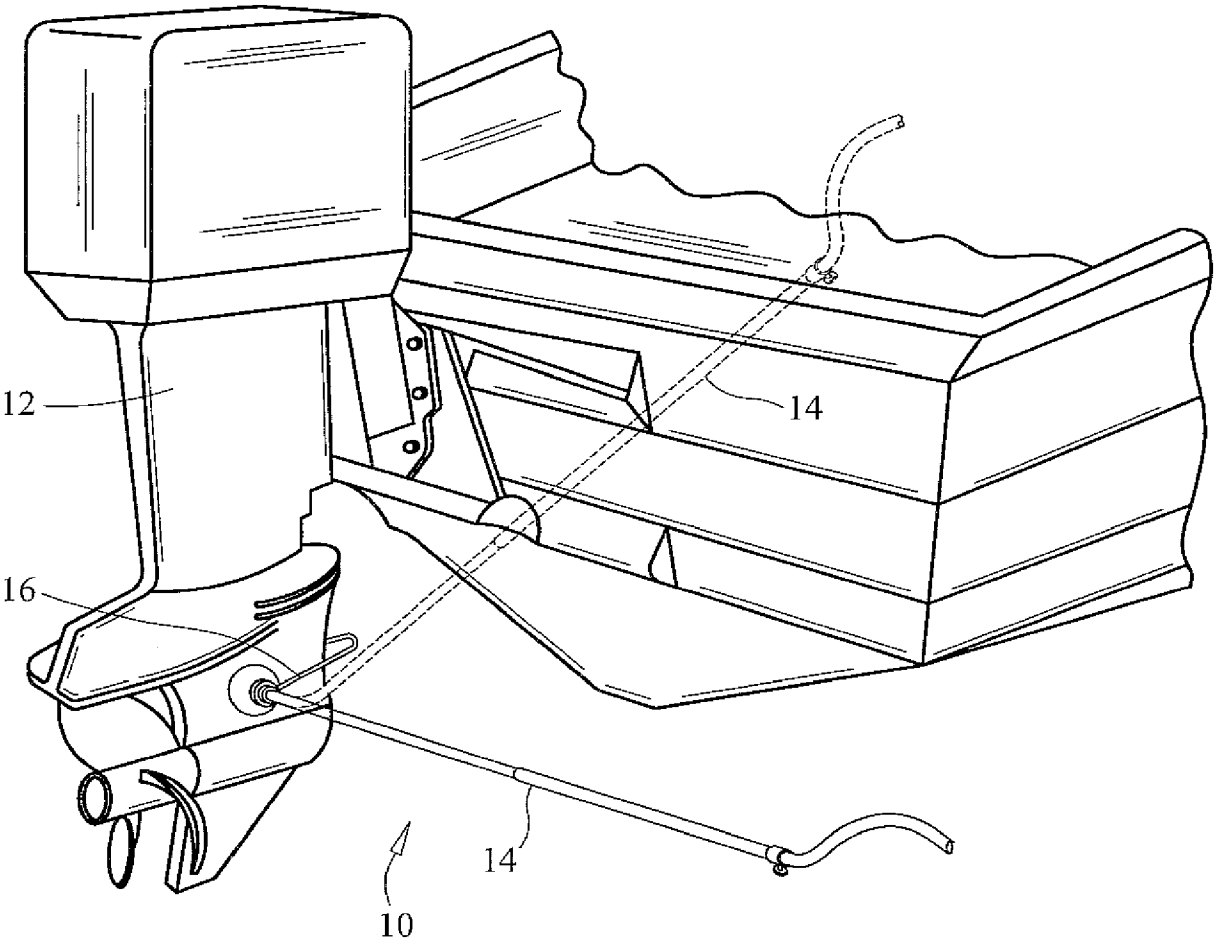
FIG. 1 is a perspective view of two embodiments of the flushing device coupled to and in an operational configuration with an outboard motor.

With reference to the drawings, FIG. 1 depicts both embodiments of the flushing system in an operational configuration in relation with an outboard motor, with the embodiment using the 90-degree connector illustrated in phantom. Flushing system 10 is mounted onto an onboard motor 12 and serves as a means through which fresh water or any type of flushing fluid is supplied from a remote location for the removal of salt water and other corrosive contaminants from the cooling system, and in particular the cooling jacket, of the outboard motor 12. Flushing system 10 includes an elongate member 14 that is connected to a generally conventional earmuff flushing accessory 16. Elongate member 14 may comprise a single telescopically adjustable member comprised of telescopically adjustable members 14*a* and 14*b* to provide extended reach. In addition, elongate member 14 may further be adapted with a tubular extender 15 to provide increased length. Flushing accessory 16 is the component of the flushing device 10 that fits around the outside of the outboard motor 12 and covers the inlet ports (not shown) with a generally watertight seal. The inlet ports are generally located at the bottom of the outboard motor 12 directly adjacent to the propeller, in order to assure that the inlet ports remain completely submerged for as long as possible while the motor 12 is being operated. Having the inlet ports disposed on the lower portion of the motor results in the inlet ports being completely submerged so as to be in constant fluid communication with the body of water in which the vessel is disposed.

The one embodiment of the present invention, the elongate member 14 is directly coupled to the earmuff flushing accessory 16 so that the elongate member 14 is either generally parallel to, or an extension of, the transverse axis that connects the inlet ports that are located on opposing sides of the outboard motor 12 and covered by the earmuff flushing accessory 16. By being generally parallel to the axis formed between the opposing inlet ports, the elongate member 14 projects perpendicularly outward from the earmuff flushing accessory 16 creating a configuration that allows for the attachment and operation of the flushing device 10 from a position directly to the side of the outboard motor. By enabling the mounting and operation of the flushing device 10 from a side position, the device is perfectly adapted for use from a remote location that is outside of the boat, such as a dock or a seawall, thereby increasing the ease by which the flushing device 10 is operated.

In an alternate embodiment of the present invention shown in FIG. 1, a 90-degree radius elbow or bent extension member 18 is coupled directly between the earmuff flushing accessory 16 and the elongate support member 14. The elbow extension member 18 serves to change the structure of the flushing device 10, so that the elongate member 14 is positioned perpendicular to the transverse axis connecting the inlet ports that are located on opposing sides of the outboard motor 12. By being perpendicular to the transverse axis that connects the opposing inlet ports, the elongate member extends out from the earmuff flushing accessory 16 in a configuration that is suited for attachment and operation of the flushing device 10 from a position directly in front or behind the outboard motor 12. Generally, a position directly in front of or behind the outboard motor 12 includes a location directly in the boat (e.g. at or near the transom), thereby allowing for the convenient operation of the flushing device even when the boat is not stationed next to a dock or a seawall.

Figure 2:
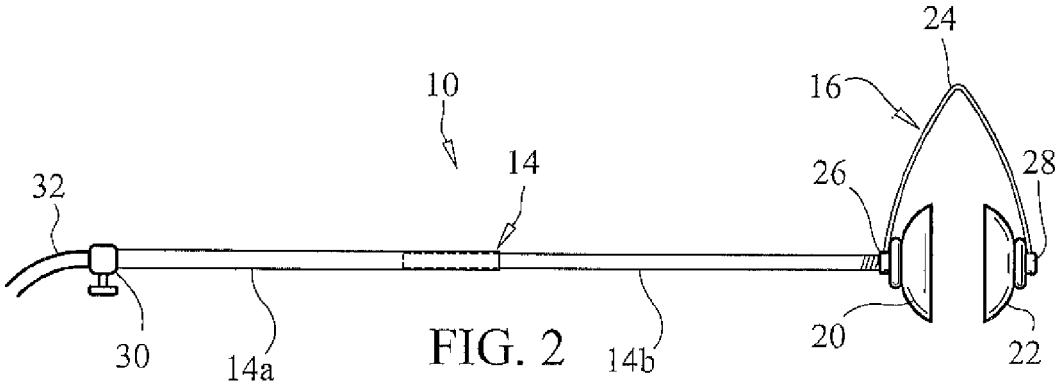
FIG. 2 is a side view of the components of the flushing device assembly for both configurations.

FIG. 2 shows a side view of the flushing device assembly for both alternative embodiments of the present invention. As mentioned previously, one embodiment of the present invention includes an elongate member 14 that is directly coupled to an earmuff flushing assembly 16. In another embodiment of the present invention, a bent elbow extension member 18 is attached between the earmuff flushing accessory 16 and the elongate member 14. In both embodiments of the invention, the elongate member 14 is hollow and is used as a passageway through which water can flow from an external pressurized source, such as a hose and into the earmuff flushing accessory 16. The elongate member 14 can be made from any suitable material for the intended function of providing not only extending and supporting the earmuff flushing accessory 16, but also providing an enclosed channel through which a flushing liquid, such as fresh water, can pass through. Preferably, the elongate member 14 is made from a material that is light weight, sturdy, and corrosion resistant.

Figure 5:
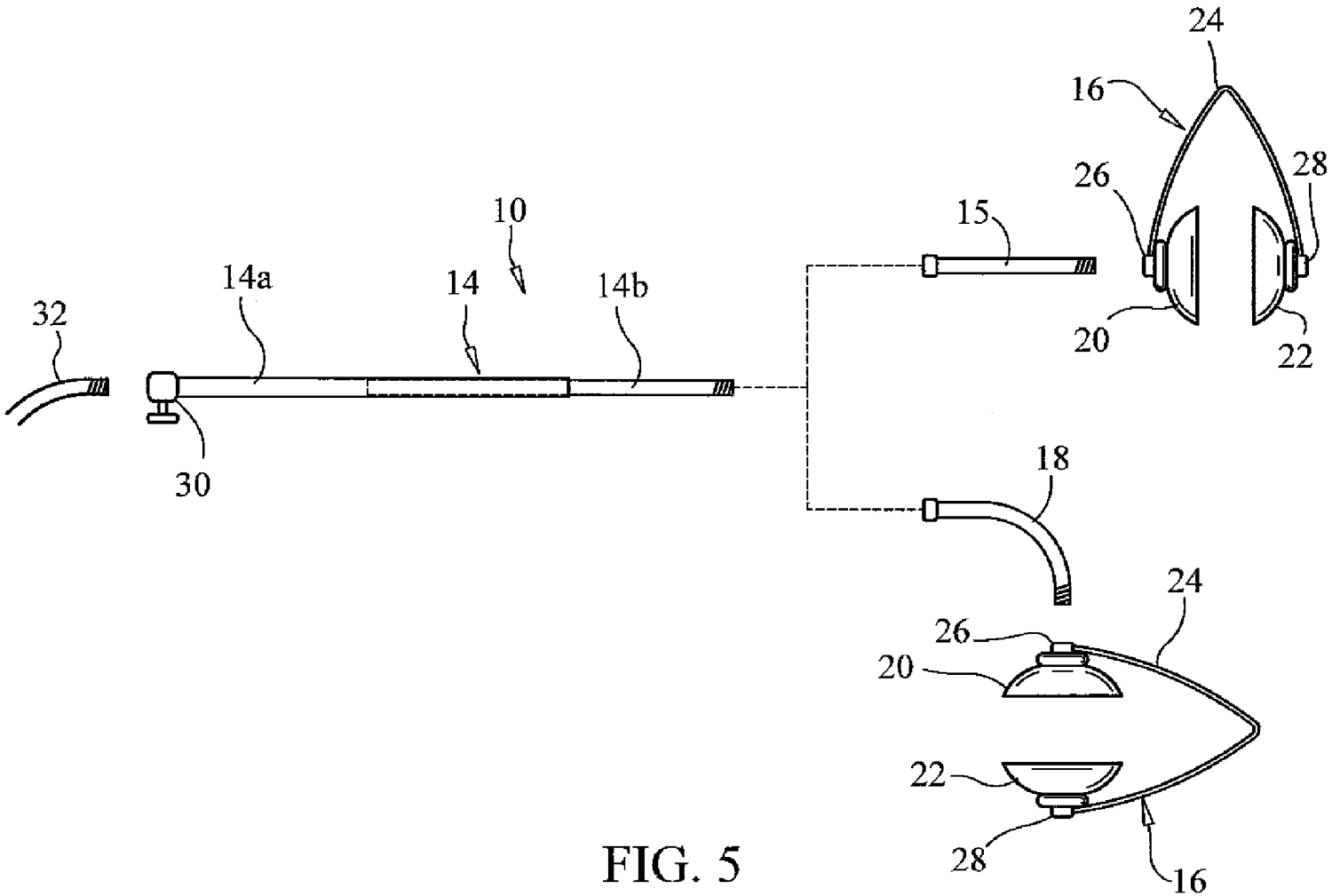
FIG. 5 is an exploded side view of the flushing device illustrating alternate configurations.

The elongate member 14 is coupled to the earmuff flushing accessory 16 through any suitable means that prevents the leaking of the flushing liquid. For example, the end of the elongate member 14 can be threaded allowing for attachment by engaging threads that form a male or female mating connection on the end of the elongate member 14 with the threads of the earmuff flushing accessory 16 that form a male or female mating connection. In the alternate embodiment of the present invention, the end of the elongate member 14 is connected to a elbow extension member 18 (preferably a 90-degree radius elbow) which is coupled to the earmuff flushing accessory 16 as illustrated in FIG. 5. The connection between the elongate member 14 and the bent extension member 18 as well as the connection between the bent extension member 18 and the earmuff flushing accessory 16 must provide a watertight connection so as to prevent the leaking of the flushing liquid. The end of the elongate member 14 can be threaded and the end of the elbow extension member 18 can be threaded so that a leak free mating connection is formed between the two components. Similarly, the opposing end of the elbow extension member 18 can be threaded and the earmuff flushing accessory 16 can also include a threaded section, so that a leak free mating connection can also be formed.

In both embodiments of the present invention, the elongate member 14 is either directly coupled to the earmuff flushing accessory 16 or connected through an elbow extension member 18, thus eliminating the need for separate components, such as separate flow tubes, that transport flushing liquid from the elongate member 14 to the earmuff flushing accessory. By eliminating the need for separate components, the design of the device 10 is simplified, leading to lowered manufacturing costs and fewer potential sources of failure.

The earmuff flushing accessory 16 is the component of the outboard motor flushing device 10 that is mounted directly onto the sides of the outboard motor to completely cover the inlet ports. The earmuff flushing accessory 16 includes a first sealing member 20 which is made from a flexible material and is generally shaped with a concave side and a second sealing member 22, which is also made from a flexible material and is generally shaped with a concave side. Both first and second sealing members 20 and 22 are positioned directly next to each other so that the concave sides of the sealing members 20 and 22 are facing each other. Through this configuration, the first and second sealing members 20 and 22 simultaneously cover and create a seal around both inlet ports so that the flushing operation can be performed. The sealing members 20 and 22 are generally of the same shape so that through the positioning, the plane located at an equal distance between the sealing members 20 and 22 is a mirror symmetry plane.

A generally V-shaped spring retaining member 24 is used to connect and subsequently affix the left and right sealing members 20 and 22 in the above mentioned position. The V-shaped spring retaining member 24 can be made of any suitable material that not only provides the necessary support required to hold the sealing members 20 and 22 in a specific position, but also is resistant to corrosion. The ends of the V-shaped spring retaining member 24 are coupled to first and second stubs 26 and 28 that protrude from the convex side of the first and second sealing members 20 and 22. One of the stubs 26 and 28 is simply a solid block of material that merely serves as a point of attachment for the V-shaped spring 24. The stub 26 located on the opposing sealing member 20 is hollow and serves as the point of connection to either the bent extension member 18 or the elongate member 14. The hollow connecting stub 26 supports any design that allows for a leak free connection including the use of threads to create a mated coupling. The hollow connecting stub 26 and the opposing stub 28 can be located on either first or second sealing member 20 and 22.

Figure 3:
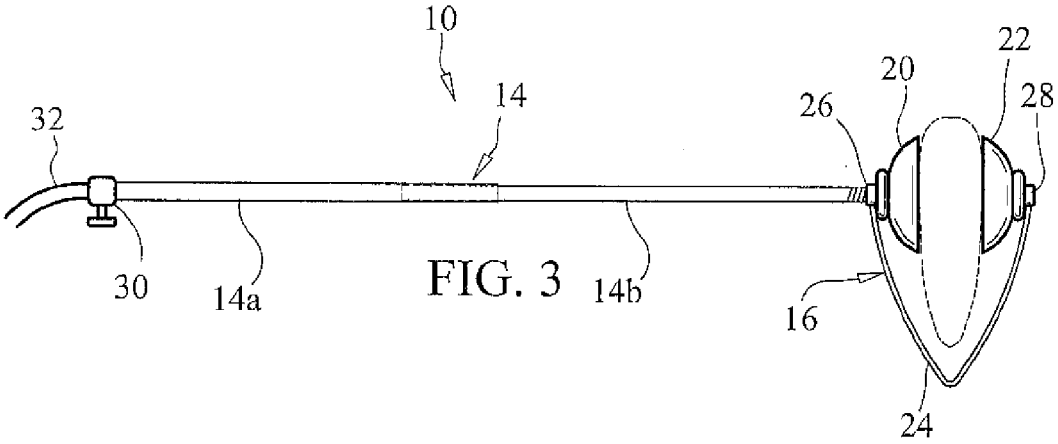
FIG. 3 is a side view of the flushing device in a configuration adapted for operation from a position directly to the side of the outboard motor.

FIG. 3 shows a side perspective view of one embodiment of the present invention. The flushing device 10 of the current embodiment consists of an elongated member 14 that is coupled directly to an earmuff flushing assembly 16. As mentioned previously, the elongated member 14 is hollow and coupled directly to a hollow connecting stub 26 located on the outside of a sealing member 20 of the earmuff flushing assembly 16. In the current embodiment, the flushing device 10 is configured for operation from a position directly to the side of the outboard motor. The elongated member 14 is telescopically adjustable to allow for the adjustment of the length of the elongated member 14 based upon the distance between the user and the outboard motor. By utilizing a telescopically adjustable elongated member, a user can quickly and efficiently adjust the length of the device, thereby dramatically increasing the ease by which the device 10 is operated. The elongate member 14 can include gripping means in order to aid the user in balancing the device 10 and preventing slippage.

Figure 4:
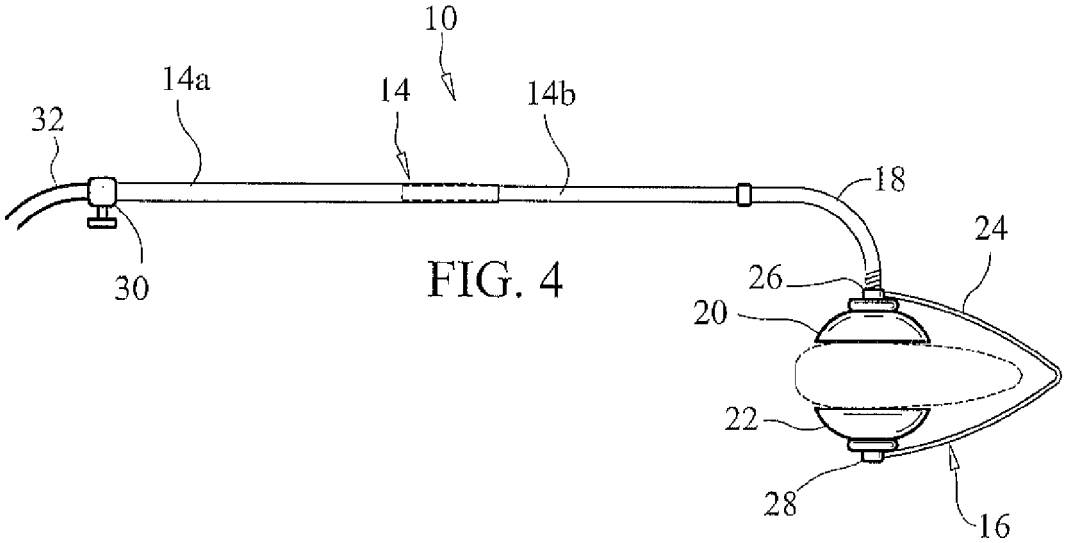
FIG. 4 is a side view of the flushing device in a configuration adapted for operation from a position directly in front of or behind the outboard motor.

FIG. 4 shows a side perspective view of an alternative embodiment of the present invention adapted with an elbow attachment. More particularly, flushing device 10 is adapted with an elbow connector 18 to configure flushing device 10 for use from a position in front of, or behind, an outboard motor. As with the previous embodiment, the elongated member 14 is telescopically adjustable thereby increasing the ease by which the device 10 is positioned and operated. Furthermore, as with the previous embodiment, the elongate member 14 can include gripping means that are use to prevent slippage and increase the ease by the user can balance the device 10.

FIG. 5 illustrates a complete kit including elongate member 14, an optional straight connection member 15, an optional elbow connection member, and an earmuff flushing accessory 16. Using elongate member 14, either alone or in combination with straight connection member 15, along with earmuff flushing accessory 16 provides a configuration particularly suitable for attachment of flushing accessory 16 to an outboard motor from the side. Using elongate member 14 in combination with elbow connection member 18 along with earmuff flushing accessory 16 provides a configuration particularly suitable for attachment of flushing accessory 16 to an outboard motor from the rear.

Referring now to both embodiments of the invention, as shown in FIGS. 3 and 4 a flow control valve 30 is placed inline at the end of the elongate member 14 opposing the end that is either directly connected to the flushing control accessory 16 or coupled to an elbow connector 18. Flow control valve 30 is used as a means for regulating and controlling the amount of flushing liquid that flows into and through the device 10. Flow control valve 30 can manually set between a fully open position which allows fluid to pass through, or a fully closed position, which does not allow fluid to pass. The rate of fluid flow is directly proportional to the opening of the flow control valve 30. The flow control valve is coupled to the end of the elongate member 14 through any suitable means of creating a leak proof connection, including but not limited to a threaded mating connection. In an alternate embodiment, the flow control valve 30 is incorporated as a monolithic component of the telescopic elongated member 14.

The flushing fluid is supplied to the elongate member 14 through a fluid supply. The flushing fluid can be supplied to the elongate member through any suitable means, such as a tube or supply hose 32. This tube or supply hose 32 is either coupled directly to the elongated member 14 or coupled to the flow valve 30 through any suitable connecting means including but not limited to a threaded mating connection.

In operation of both embodiments of the present invention, a user operates the device 10 from a position that is either to the side, front, or behind the outboard motor depending on the configuration that is created by the specific embodiment. The user adjusts the telescopic elongated member 14 to a suitable length and positions the earmuff flushing assembly 16 so that the sealing members 20 and 22 maintain contact with the outside of the outboard motor and completely cover the inlet ports. Due to the flexibility of the sealing members 20 and 22, a seal is created between the members and the side of the outboard motor. Once the flow valve 30 is opened, flushing liquid flows from a source, into the elongated member 14. Once in the elongated member 14, the fluid either flows directly through a hollow connecting stub 26, or into a bent extension member 18, before finally flowing through a hollow connecting stub 26 and into the empty chamber formed between the side of the motor and the concave walls of the sealing member 20.

Due to the seal formed by the sealing members 20 and 22, the fluid that enters into the chamber defined between sealing members 20 and 22 is forced into the inlet port of the outboard motor. The fluid flows through the entire cooling system of the outboard motor, including the cooling Jacket and out through a discharge line. The flow of liquid though the cooling system causes the expulsion of salt water and other particles, including corrosive agents, through the discharge line. The flushing operation is stopped by either closing the control valve 30 or disconnecting the flushing fluid supply source. The device 10 is removed from the outboard motor by simply rupturing the seals formed by the sealing members 20 and 22, and displacing the earmuff flushing accessory 16 away from the outboard motor.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An outboard motor flushing kit capable of being assembled in the field for flushing a marine engine outboard motor having cooling water inlets, the flushing kit comprising the combination of:

a flushing accessory including a pair of sealing elements for covering the cooling water inlets of the outboard motor, at least one of said sealing elements having a passageway for supplying water to one of the cooling water inlets and having a coupling extending therefrom, and a retaining member having a pair of arms with one sealing element attached to each arm;

an elongate sturdy tubular member capable of horizontally supporting and remotely positioning said flushing accessory on the outboard motor, said tubular member having a first end adapted for direct connection with said flushing accessory coupling in fluid communication with said passageway thereby allowing for deployment of said flushing accessory from a remote location, and a second end adapted for connection to a source of pressurized water, said tubular member further including a manually actuated flow control valve; and first and second tubular extension members for alternate use with said flushing accessory and said tubular member, including;

a first, generally straight, tubular extension member having opposing ends adapted for selective connection to said flushing accessory and said elongate member first end such that the flushing system is configured for supporting and attaching said flushing accessory to the cooling water inlets of a marine motor from a side position relative to the motor; and a second, 90-degree elbow, tubular extension member having opposing ends adapted for selective connection to said flushing accessory and said elongate member first end such that the flushing system is configured for supporting and attaching said flushing accessory to the cooling water inlets of a marine motor from a rear position relative to the motor.

2. The outboard motor flushing kit according to claim 1, wherein said elongate tubular member is telescopically adjustable.

3. An outboard motor flushing kit capable of being assembled in the field for flushing a marine outboard motor having cooling water inlets, the flushing kit comprising the combination of:

an ear-muff type flushing accessory including a pair of sealing elements for covering the cooling water inlets of an outboard motor, at least one of said sealing elements having a passageway for supplying water to one of the cooling water inlets with a hollow connecting stub extending therefrom, and a retaining member having a pair of arms with one sealing element attached to each arm;

a telescopically adjustable an elongate tubular member capable of horizontally supporting and remotely positioning said flushing accessory on the outboard motor, said tubular member having a first end adapted for direct coupling connection with said flushing accessory hollow connecting stub in fluid communication with said passageway, and a second end adapted for connection to a source of pressurized water, said tubular member further including a manually actuated flow control valve; and first and second tubular extension members for alternate in-line connection between said flushing accessory and said elongate tubular member;

said first tubular extension member characterized as being generally straight with opposing ends, including a first end adapted for selective connection to said flushing accessory and a second end adapted for selective connection to said elongate member first end such that the flushing system is configured for supporting and attaching said flushing accessory to the cooling water inlets of an outboard motor when the user is positioned generally along side of the motor;

said second tubular extension member characterized generally as a tubular 90-degree elbow having opposing ends, including a first end adapted for selective connection to said flushing accessory and a second end adapted for selective connection to said elongate member first end such that the flushing system is configured for supporting and attaching said flushing accessory to the cooling water inlets of an outboard motor when the user is positioned generally in front or behind the motor.

* * * * *